United States Patent [19]

Mattingly et al.

[11] 4,269,012

[45] May 26, 1981

[54] STANDING SEAM ROOF, PANEL THEREFOR, AND METHOD OF INSTALLATION

[75] Inventors: John A. Mattingly, St. Louis; Hasmukh S. Mehta, Manchester, both of Mo.

[73] Assignee: The Binkley Company, Warrenton, Mo.

[21] Appl. No.: 8,434

[22] Filed: Feb. 1, 1979

[51] Int. Cl.[3] ..... E04D 3/362

[52] U.S. Cl. ..... 52/394; 52/393; 52/410; 52/520; 52/542; 52/748

[58] Field of Search ..... 52/542, 588, 519, 520, 52/394, 533, 545, 543, 746, 747, 748, 393, 410

[56] References Cited

U.S. PATENT DOCUMENTS

| | | | |
|---|---|---|---|
| 3,157,965 | 11/1964 | Watson | 52/520 |
| 3,427,775 | 2/1969 | Bachrich | 52/402 |
| 3,708,943 | 1/1973 | Thomas | 52/588 |
| 4,102,105 | 7/1978 | Taylor | 52/520 |
| 4,139,974 | 2/1979 | Fox | 52/542 |

FOREIGN PATENT DOCUMENTS

| | | | |
|---|---|---|---|
| 257361 | 9/1960 | Australia | 52/588 |
| 1183638 | 7/1959 | France | 52/520 |

*Primary Examiner*—John E. Murtagh

*Attorney, Agent, or Firm*—Senniger, Powers, Leavitt and Roedel

[57] ABSTRACT

A sheet metal panel for a standing seam roof, a standing seam roof formed of the panels, and a method of installing the roof. Each panel is generally in the form of a shallow channel, having a web and first and second flanges extending up from the web at opposite sides of the web. The first flange has a downwardly opening channel section at its upper margin on the outside, with a sealing strip in this channel section. The second flange has a sealing lip section at its upper margin on the inside. In the roof, the panels are mounted alongside one another on the panel supporting means (e.g., purlins) of the roof, with the first and second flanges of adjacent panels alongside one another and with the lip section on the second flange of one of two adjacent panels sealingly engaging the sealing means in the channel section on the first flange of the other of two adjacent panels. Each panel is held down by a clip secured to the supporting means having a thin flat leg extending up between the first and second flanges of adjacent panels and a hook hooked over the top of the second flange.

12 Claims, 9 Drawing Figures

STANDING SEAM ROOF, PANEL THEREFOR, AND METHOD OF INSTALLATION

BACKGROUND OF THE INVENTION

This invention relates to standing seam roofs, panels therefor, and methods of installing same.

The invention is especially concerned with roof panels for a so-called standing seam roof, which is basically a type of roof formed of elongate sheet metal panels generally of shallow channel shape in transverse cross section, comprising a web and upwardly extending side flanges at opposite sides of the web, the panels being laid one alongside another on supporting means therefor of the roof (e.g., roof purlins) with their flanges standing upward side-by-side and being seamed together, thus accounting for the designation of the structure as a "standing seam" roof. A variety of such panels have been on the market, but, so far as applicants are aware, all of them have been based on systems requiring rolling or other metal-forming operations on the flanges of the panels after they have been laid on the roof to form sealed seams as are necessary for weathertightness. Other problems have also been encountered with the prior standing seam roof systems such as disposal of moisture which may condense on interior surfaces of the panels in the seams.

SUMMARY OF THE INVENTION

Among the several objects of this invention may be noted the provision of an improved roof panel for a standing seam roof adapted for easy assembly in place on a roof to form a substantially leak-proof standing seam roof, without requiring any metal-forming operations on the flanges of the panels after they have been laid on the roof; the provision of such a panel adapted on assembly on the roof to form sealed standing seams, such as are necessary for watertightness, simply in the course of assembly, without the use of any crimping tools or the like; the provision of such a panel which is so formed that, on assembly with other panels in a standing seam roof system, the system is adapted readily to dispose of moisture which may enter or condense in the system; the provision of a standing seam roof system embodying said panels and secured to the roof supporting means (e.g., roof purlins) in a simple economical manner which holds the panels down against being uplifted by wind and which allows thermal expansion of the panels; the provision of such a system which includes a thermal break (insulation) between the panels and the roof supporting means (e.g., roof purlins); and the provision of a method of installing the said panels to form a standing seam roof in easy, rapid and economical manner.

In general, a roof panel of this invention for a standing seam roof is an elongate sheet metal panel having a web adapted to bear on panel supporting means of a roof and first and second flanges extending up from the web at opposite sides of the web. A panel is adapted to be mounted on the supporting means adjacent another panel with the webs of the panels bearing on the supporting means, with the flanges standing up from the supporting means, and with the first flange of the one panel alongside the second flange of the other. The first flange of the panel has an integral downwardly opening channel section extending longitudinally along its upper margin on the outside of the first flange. This channel has a sealing means (e.g., a gasket) therein. The second flange has an integral sealing lip section extending longitudinally along its upper margin on the inside of the second flange adapted to fit in the channel section of an adjacent panel on the supporting means, this lip section being sealingly engagable with the sealing means in the latter channel section to form a sealed standing seam.

A standing seam roof of this invention comprises roof panel supporting means (e.g., purlins) and a plurality of the above-described panels mounted on the supporting means one alongside another with their webs on the supporting means and their flanges standing up from said supporting means, with the first and second flanges of adjacent panels alongside one another, and with the lip section on the second flange of one of two adjacent panels sealingly engaging the sealing means in the channel section on the first flange of the other of two adjacent panels. Each panel is held down on the roof supporting means by hold-down means secured to the supporting means, this hold-down means having a relatively thin leg extending up between the first and second flanges of adjacent panels and means at its upper end extending over the sealing lip section at the upper margin of the second flange.

The method of this invention comprises mounting a first of said panels on panel supporting means of a roof with its web engaging said supporting means and its flanges standing up, applying hold-down means for holding the first panel down on said supporting means, the holddown means being secured to said supporting means adjacent the second flange of the first panel and having a relatively thin leg extending up on the outside of said second flange and means at its upper end extending over the sealing lip section of said second flange. Then a second panel is assembled with the first panel alongside the first panel with the web of the second panel engaging said supporting means and its flanges standing up, the first flange of the second panel extending alongside the second flange of the first panel on the outside of said second flange and said leg of said holding means, and with the lip section on the second flange of the first panel in the channel section on the first flange of the second panel and sealingly engaging the sealing means in said channel section. Then hold-down means is applied for holding down said second panel similarly to the applying of the hold-down means for the first panel. A third panel is assembled with the second panel similarly to the assembling of the second panel with the first panel, and further hold-down means and panels are added in similar manner.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
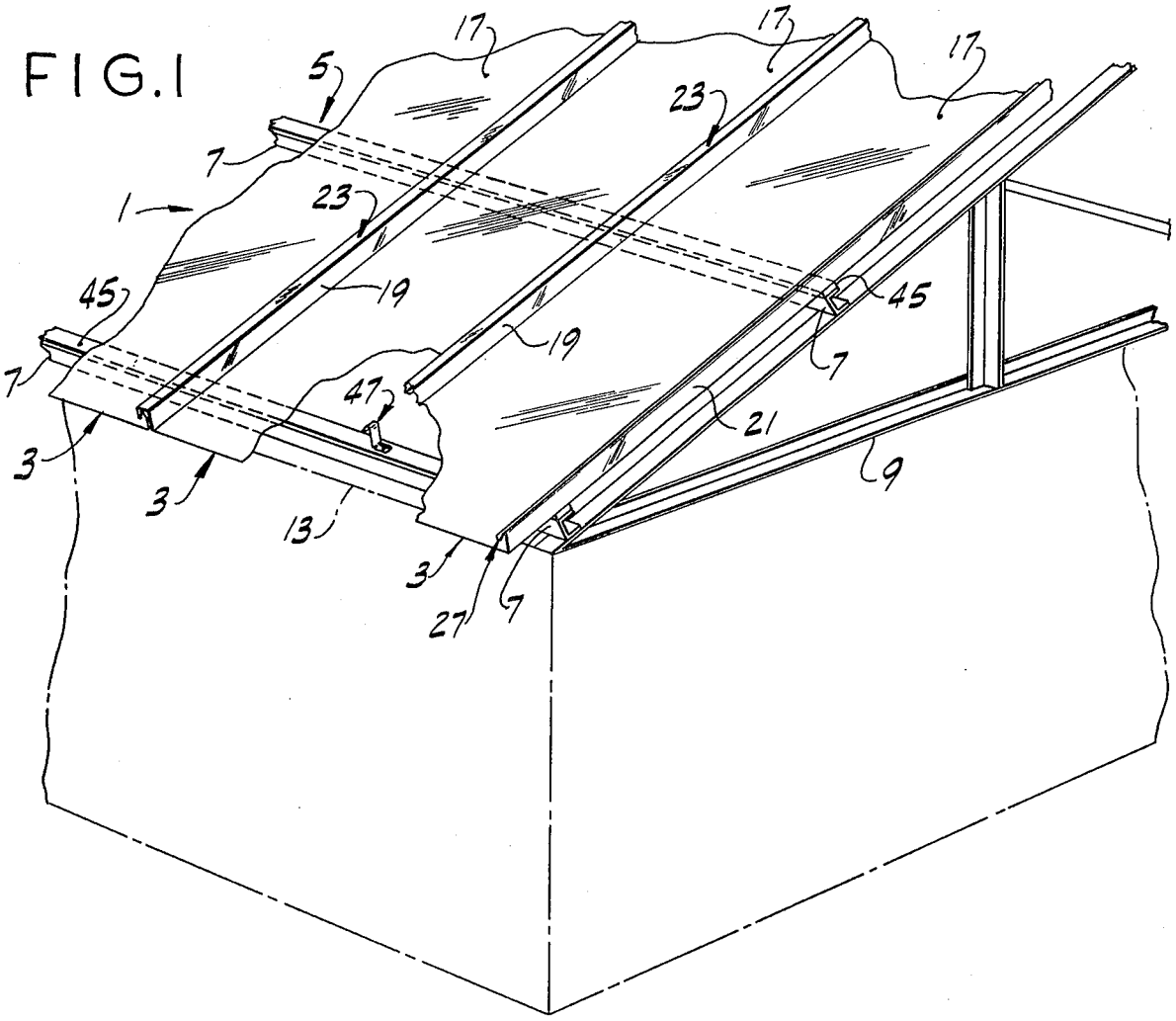
FIG. 1 is a view illustrating a standing seam roof of this invention comprising roof panels of this invention on purlins extending lengthwise of the roof on roof trusses.
Figure 2:
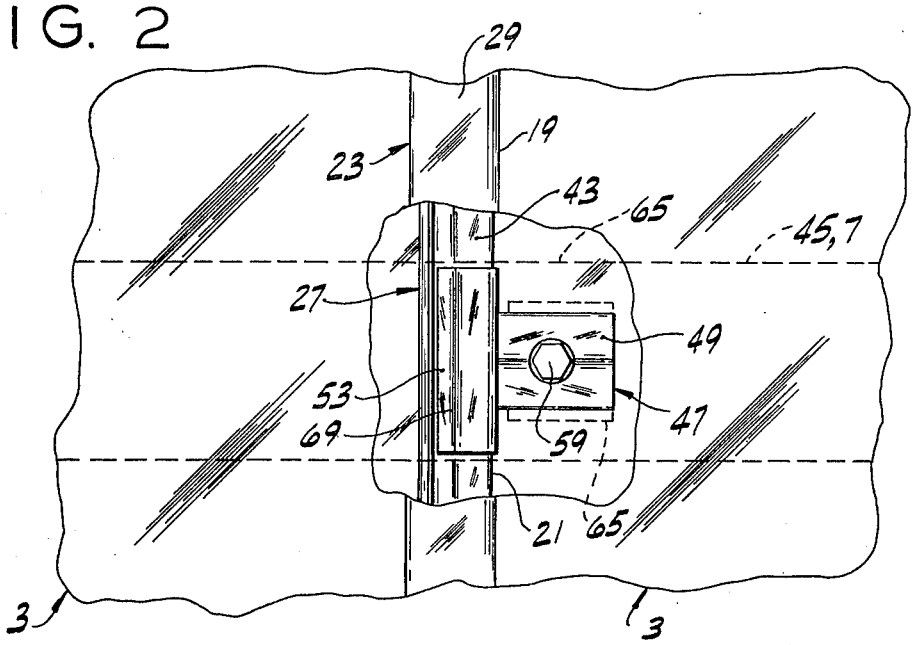
FIG. 2 is a plan of part of two adjacent panels of the roof with parts broken away to show a clip used to hold down a panel.
Figure 4:
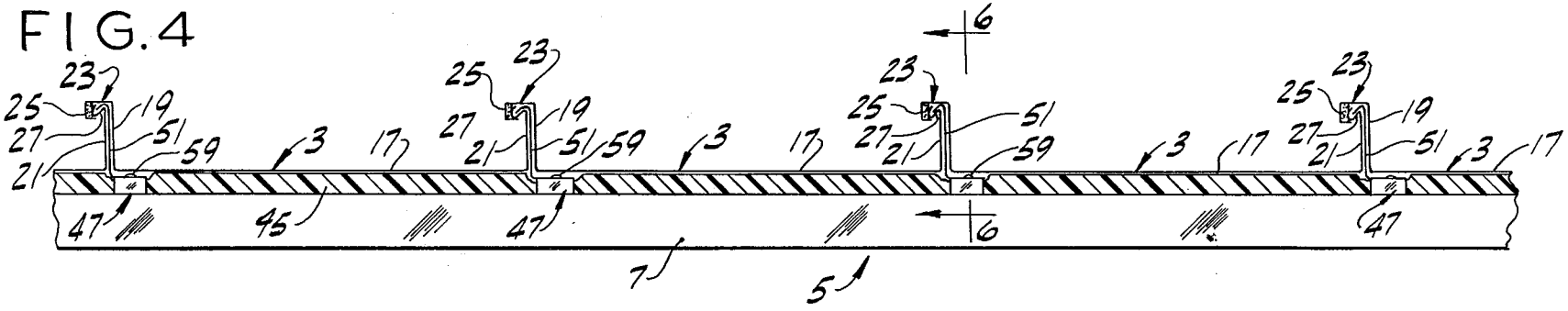
FIG. 4 is a section of the roof on line 4—4 of FIG. 3.
Figure 3:
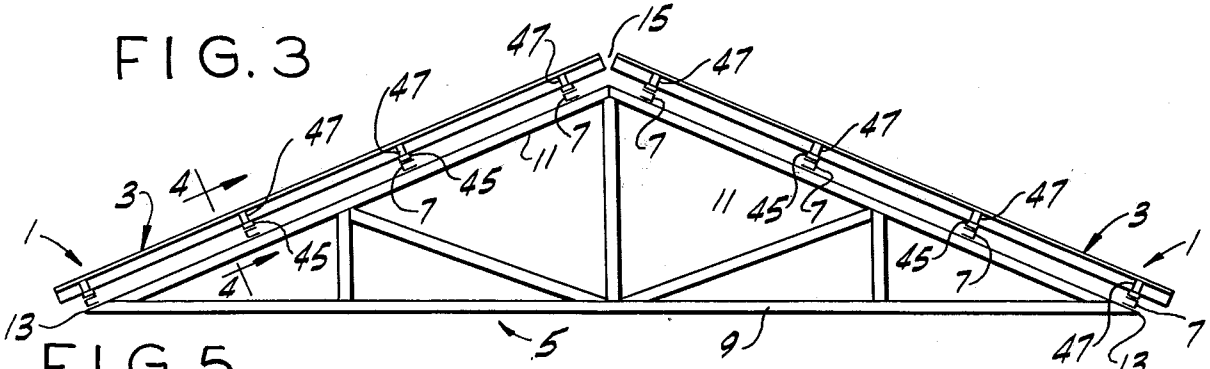
FIG. 3 is an end view of the roof, showing a roof truss and the purlins.

Referring to the drawings, there is generally indicated at 1 in FIGS. 1, 3 and 4 a standing seam roof system of this invention comprised of elongate sheet metal panels 3 of this invention laid on panel supporting means generally designated 5 and comprising roof purlins 7 supported on conventional triangular roof trusses such as indicated at 9. The roof system indicated at 1 in FIG. 1 is half the entire roof shown in FIG. 3. It will be understood that the entire roof in effect comprises two of the roof systems 1, one on each side of the structure, each comprising an assembly of panels 3. The purlins 7 extend horizontally over the upper chords 11 of the trusses 9, and the individual panels of each roof system extending transversely with respect to the purlins over the purlins from the eave 13 up to the ridge at 15 of the roof.

A peaked roof (on the triangular trusses 9) is shown only by way of example. It will be understood that the roof could be a flat roof, or any other type of roof where it may be desired to have a standing seam roof system. It will be understood that suitable flashing (not shown) may be provided at the ridge 15 in FIG. 3.

Each of the panels 3 (they are all identical) is formed of suitable sheet metal for roofing purposes, such as galvanized sheet steel or aluminum to have a web 17 adapted to bear on the panel supporting means 5 of the roof structure and first and second flanges 19 and 21 extending up from the web at opposite sides of the web. The panel may be formed of 26-22 gauge steel, for example, the web having a width of 16 inches and the flanges having a height of 2½ inches, for example. A panel 3 is adapted to be mounted on the supporting means 5 adjacent another panel 3 with the webs 17 of the panels bearing on the supporting means 5 and with the flanges 19 and 21 standing up from the supporting means 5 (see FIGS. 1, 4 and), and with the first flange 19 of one panel alongside the second flange 21 of the other.

The first flange 19 of the panel 3 has an integral downwardly opening channel section 23 extending longitudinally along its upper margin on the outside thereof. This channel section has sealing means 25 therein, more particularly a strip of flexible resilient sealing material such as polyvinyl chloride or neoprene or caulking sealant extending longitudinally in the channel section. The second flange 21 has an integral sealing lip section 27 extending longitudinally along its upper margin on the inside thereof adapted to fit in the channel section 23 of the adjacent panel on the supporting means 5, the lip section being sealingly engageable with the sealing means 25 in the latter channel section to form a sealed standing seam.

The channel section 23 of the panel 3 more particularly comprises a relatively narrow upper web 29 extending laterally outwardly from the first flange 19 of the panel at the upper edge of this flange, an outer flange 31 extending down from the upper web 29 at the outer edge of the upper web 29, and a lower lip 33 extending laterally inwardly from the outer flange 31 at the lower edge of the outer flange 31. The sealing means 25, constituted by the strip of polyvinyl chloride, for example, extends along the outer flange 31 of the channel section 23 on the inside of flange 31, in the space bounded by web 29, flange 31 and lip 33, being suitably adhered as by means of any suitable adhesive to the inside face of flange 31.

Figure 9:
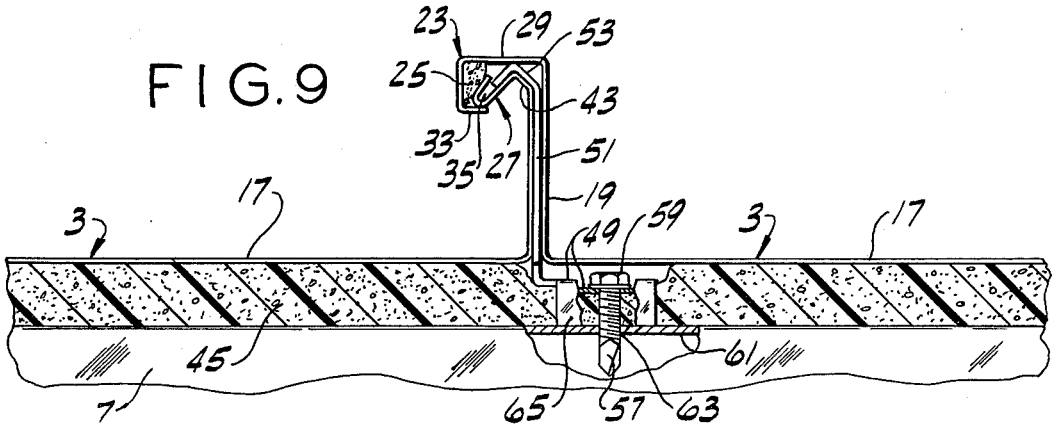

The lip section 27 is so shaped in cross section as to form a trough or gutter 35 for draining off water, the gutter being formed by a flange portion 37 of the sheet metal of the panel bent to extend inwardly and downwardly from the upper edge of the upstanding flange 21 of the panel, and an integral lip 39 on the flange bent to extend upwardly and outwardly from the lower edge of the flange portion 37. The flange portion 37 forms what may be called the outer wall of the gutter, the lip 39 forms what may be called the inner wall of the gutter and the juncture 41 of these walls forms the bottom of the gutter. The gutter is inclined downwardly and outwardly from the upper edge of flange 21, and its lip or inner wall 39 is engageable with the sealing means or strip 25 as appears in FIG. 9. The gutter is integrally joined to the flange 21 by a fillet 43 extending upwardly and outwardly from the upper edge of flange 21 to the upper edge of the outer wall 37 of the gutter. This fillet is adapted in effect to extend across the corner of web 29 of the channel section 23 and the flange 19 of the adjacent panel 3. The distance L1 from the second flange 21 to the outside of the bottom 41 of the gutter is somewhat greater than the distance L2 from the first flange 19 to the edge of the lower lip 33 of the channel section 33.

In installing a roof, a first panel 3 is mounted on the purlins 7 at one end of the roof structure extending transversely with respect to the purlins from the eave 13 up to the ridge 15, with its flange 19 at or adjacent that end of the roof, and its flange 21 inward from that end of the roof. The panel may, for example, be laid on the purlins at the left end of the roof structure as viewed in the direction toward the ridge 15, with its flange 19 at the left and its flange 21 at the right. In many instances, and particularly where the purlins are metal purlins, such as light gage steel channels as best illustrated in FIG. 1, a thermal break is provided between the panel and the purlins by laying a strip of thermal insulation material and more particularly a strip of cellular insulation such as the expanded synthetic resinous material sold under the trade name Styrofoam by Dow Chemical Co., on top of each of the purlins extending longitudinally of the purlins. These thermal break strips on the purlins are indicated at 45 in FIGS. 1–4 and 6–9. It will be understood that in many instances, the roof will be insulated by means of batts of suitable insulation such as fiberglass insulation material (not shown in the drawings) laid on the purlins, and in such instances, the thermal break strips 45 are placed on the fiberglass insulation. Otherwise, the thermal break strips are placed directly on the purlins.

The first panel 3 is mounted on the purlins 7 with the web of the panel engaging the top of the strips 45 on the purlins and with its first and second flanges 19 and 21 extending upwardly, and means comprising clips generally designated 47 is applied for holding the first panel down on the purlins. Each clip is formed of light gage metal, having a base section 49 by means of which it is secured to a purlin, a relatively thin flat leg 51 extending up from the base section, and means at the upper end of the leg comprising an integral hook 53 adapted to hook over the sealing lip section 27 on flange 21 of a panel 3.

For the securement of the clip to a purlin, the base section 49 of the clip has a hole 55 for receiving a fastener such as a self drilling and tapping sheet metal screw 57 in the case where the purlins are light gage metal members. The screw 57, having a head 59, is adapted to be driven down through the strip 45 on a purlin into the upper flange 61 of the purlin, forming a hole at 63 in the purlin and threading its way into the hole 63. The base section 49 of the clip has downwardly extending flanges 65 at opposite sides thereof adapted to penetrate into the Styrofoam strip 45 (the Styrofoam material being readily pierced). Initially, as manufactured, the base section of the clip is flat and the flanges 65 extend generally at right angles to the base section. When the clip is fastened to a purlin by the screw 57, the base section 49 is curved down and the flanges angle out as appears in FIG. 6.

The overall height of the clip 47, as it is initially formed, from the lower edges 67 of the flanges 65 to the top 69 of the hook 53 is so related to the height of the second flange 21 of a panel that, with the base section 49 of the clip secured to a purlin 7 and with the flanges 65 of the base section 49 of the clip extending down through strip 45 to the top of the purlin 7, the second flange 21 of the panel is tightly secured to the purlin by the clip. The flanges 65 are readily forced down into and through the Styrofoam strip. Also, the height of the flanges 65 is generally less than the thickness of the strip 45, and the base section 49, as shown in FIGS. 4 and 6–9, is embedded in the strip (the Styrofoam material being readily crushed for such embedment).

Figure 6:
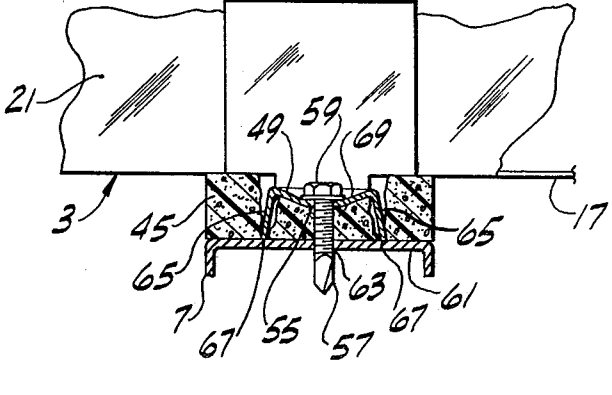
FIG. 6 is an enlarged section on line 6—6 of FIG. 4, showing a hold-down clip.
Figure 5:
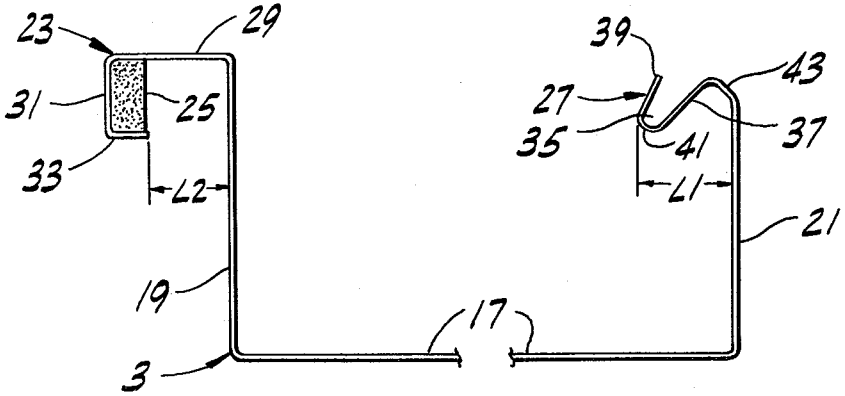
FIG. 5 is an enlarged end elevation of a panel, partly broken away to reduce the width of the view.

Generally, a clip 47 is secured to each purlin 7 for holding down the panel 3, although fewer clips may be used in some instances. It is also possible that in some instances, fasteners may be driven through the web 17 of a panel 3 into the upper flange of a purlin to provide additional hold-down. After the first panel 3 has been laid on the purlins, a clip is placed on each strip 45 on a purlin with its base section 49 (which is flat at this time) on strip 45, with its leg 51 lying flat against the outside of flange 21 of the panel and its hook 53 overlying the fillet 43 at the top of flange 21. Then, a self drilling and self tapping screw 57 is inserted in the hole 55 in the base section of the clip and driven down by a power tool through the strip 45 and into the upper flange 61 of the purlin. The screw threads itself into the hold 63 it forms in flange 61 and as it is turned to tighten it, the flanges 65 on the base section 49 of the clip penetrate into the strip 45 (the Styrofoam material being readily penetrable) to the point where their lower edges 67 engage the upper flange 61 of the purlin. Turning of the screw is continued to thread it farther into the hold 63, resulting in the base section 49 curving down to form a recess 69 for the head 59 of the screw and the flanges 65 spreading out as shown in FIG. 6, the hook 53 of the clip being drawn down tightly on the fillet 43 at the top of the flange 21 of the panel in effect with a spring action due to the bending of the base section, thereby tightly to secure the flange 21 of the panel 3 to the purlin. The base section 49 of the clip sinks into the strip 45 and becomes embedded therein as appears in FIGS. 4 and 6–9.

Next, a second panel 3 is assembled with the first panel 3 alongside the first panel, the assembly being such that the web of the second panel engages the styrofoam thermal break strips 45 on the purlins 7, the flanges of the second panel standing up with the first flange 19 of the second panel extending alongside the second flange 21 of the first panel on the outside of said second flange 21 and on the outside of said thin flat leg 51 of the clip 47 (which lies flat on the outside of second flange 21 of the first panel), and with the lip section 27 on the second flange 21 of the first panel in the channel section 23 on the first flange 19 of the second panel and sealingly engaging the sealing strip 25 in the channel section 23. Once the second panel 3 is in place, a clip 47 is applied for holding it down similarly to the application of the clip 47 for the first panel. Then, a third panel 3 is assembled with the second panel 3 similarly to the assembling of the second panel 3 with the first panel 3 and the addition of panels and clips is continued in similar manner until all the panels for the roof have been installed.

Figure 7:
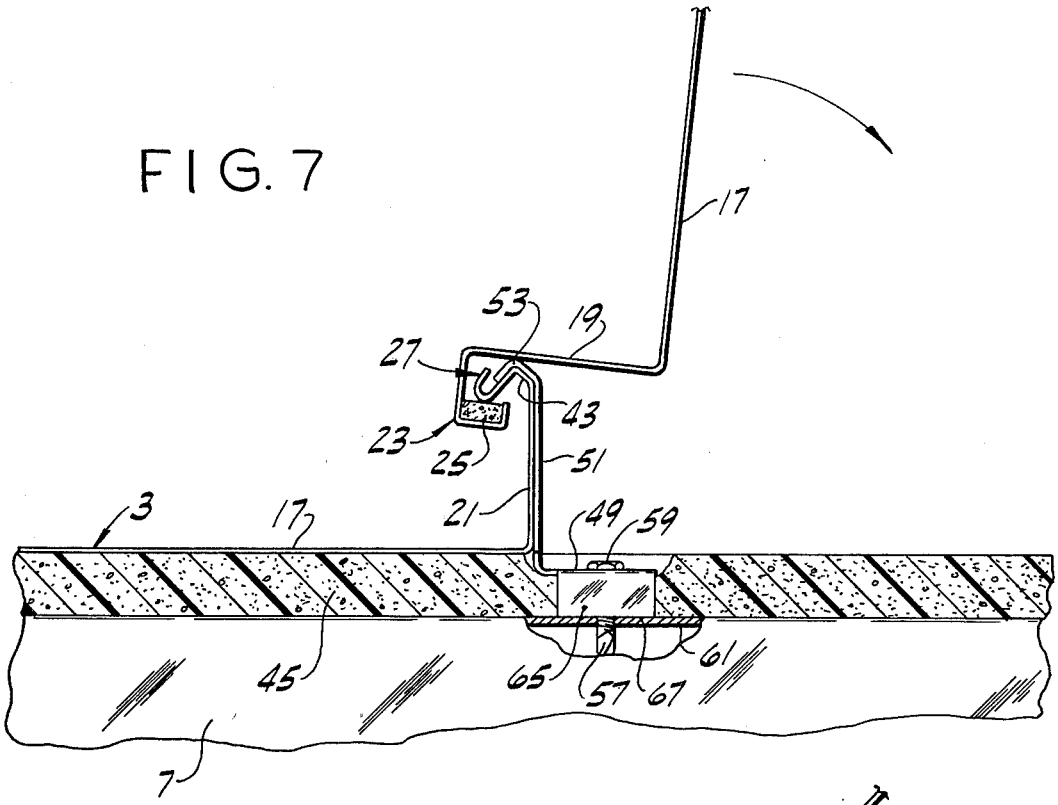
FIGS. 7–9 are enlarged fragmentary sections showing in sequence how the panels are installed to form a standing seam roof in accordance with this invention.
Figure 8:
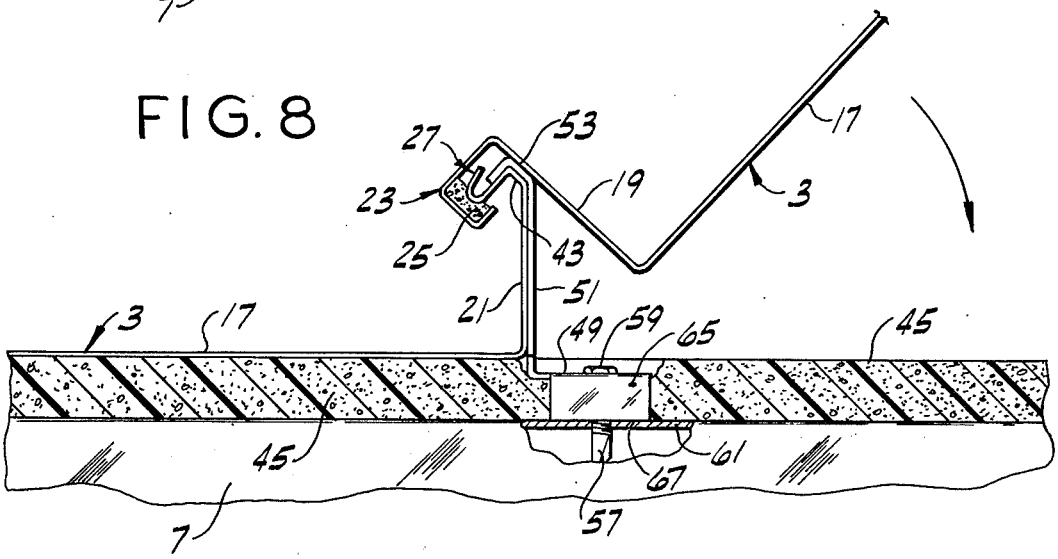

It is preferred that the installation be carried out by interengaging the channel section 23 on the first flange 19 of each successive panel 3 with the lip section 27 of the preceding panel 3 as shown in FIG. 7 with the sealing strip 25 in the channel section 23 extending under the lip section 27 and with the web 17 of the successive panel above the strips 45 on the purlins 7, then swinging the successive panel around and down as indicated by the arrows in FIGS. 7 and 8 to bring the web 17 of the successive panel down onto the strips 45 on the purlins 7. This also brings the first flange 19 of the successive panel into position on the outside of the second flange 21 of the preceding panel and on the outside of the thin flat leg 51 of the clips 47, with the lip section 27 on the second flange 21 of the preceding panel in the channel section 23 on the first flange 19 of the succeeding panel and sealingly engaging the sealing strip 25 in said channel section 23.

Thus, the completed roof is a standing seam roof having roof panel supporting means, e.g., the roof trusses 9, the purlins 7 on the trusses, and the strips 45 (if used) on the purlins, and a plurality of the panels 3 mounted thereon one alongside another with their webs 17 on the supporting means and their flanges 19 and 21 standing up from the supporting means. The first and second flanges 19 and 21 of adjacent panels are alongside one another with their webs 17 on the supporting means (on strips 45 on purlins 7) and with the lip section 27 on the second flange 21 of one of two adjacent panels sealingly engaging the sealing strip 25 in the channel section 23 on the first flange 19 of the other of two adjacent panels to form a leak-proof seam. Clips 47 secured to the supporting means (to the purlins 7) hold the panels down on the supporting means via hooks 53 of the clips being hooked over the top of the flanges 21. The panels 3 are assembled to form the standing seam roof, with the roof substantially leak-proof by reason of the overlap of the channel sections 23 on the lip sections 27, and the sealing engagement of the lip sections 27 with the sealing strips or gaskets 25 in the channel sections 23, without requiring any metal-forming operations the flanges of the panels after they have been laid on the roof, i.e., without requiring the use of any crimping tools or the like. Moisture which may condense on a surface in a seam such as on the bottom of web 29 of the channel section 23 or on the inside of wall 37 of the lip section drains out in the gutter 35; the latter also acts as a "siphon break" for disposal of water which may enter the seam by capillary action. Clips 47 with their hooks 53 hooked over the top of the flange 21 of a panel at one side of the panel and lip 33 of channel section 23 of the panel engaged under the bottom of the lip section 27 of the adjacent panel at the other side of the panel hold the panel down at both sides against being uplifted by wind, the panel still being able to expand and contract longitudinally with temperature changes. The clips are advantageously wholly concealed.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. An elongate sheet metal panel for a standing seam roof having a web adapted to bear on panel supporting means of a roof and first and second flanges both extending up from the web at opposite sides of the web, said panel being adapted to be mounted on said supporting means adjacent another panel with the webs of the panels bearing on said supporting means, with said flanges standing up from said supporting means, and with the outside of the first flange of one panel alongside the outside of the second flange of the other, the first flange of the panel having an integral downwardly opening channel section extending longitudinally along its upper margin on the outside thereof, said channel section being provided with sealing means therein before assembly with another panel on said supporting means, said second flange having an integral sealing lip section extending longitudinally along its upper margin on the inside thereof adapted to fit in the channel section of an adjacent panel on said supporting means and sealingly engageable with the sealing means in the latter channel section to form a sealed standing seam, the channel section comprising an upper web extending laterally outwardly from the first flange at the upper edge of the first flange, and an outer flange extending down from the upper web at the outer edge of the upper web, the sealing means extending along said outer flange of said channel section, said lip section of the panel having an outer edge portion engageable with the sealing means of the channel section of the adjacent panel, said channel section further comprising a lower lip extending laterally inwardly from the outer flange of the channel section at the lower edge of said outer flange, said sealing means comprising a strip of flexible resilient material adhered to the inside of said outer flange between said upper web and said lower lip and facing toward the first flange of the panel.

2. A standing seam roof panel as set forth in claim 1 wherein said lip section is so shaped in transverse section as to form a gutter for draining off water, the gutter having a bottom, an inner wall and an outer wall, and the gutter being engageable with the sealing means of the channel section in the adjacent panel.

3. A standing seam roof panel as set forth in claim 2 wherein the gutter is inclined downwardly and outwardly and its inner wall is engageable with the sealing means.

4. A standing seam roof panel as set forth in claim 2 wherein the gutter is integrally joined to the said second flange via a fillet extending upwardly and outwardly from the upper edge of the second flange to the upper edge of the outer wall of the gutter, said fillet being adapted to extend across the corner of the upper web of the channel section and the first flange of the adjacent panel.

5. A standing seam roof having a roof panel supporting means and a plurality of panels, each panel having a web adapted to bear on the panel supporting means and first and second flanges both extending up from the web at opposite sides of the web, said panel being adapted to be mounted on said supporting means adjacent another panel with the webs of the panels bearing on said supporting means, with said flanges standing up from said supporting means, and with the outside of the first flange of one panel alongside the outside of the second flange of the other, the first flange of the panel having an integral downwardly opening channel section extending longitudinally along its upper margin on the outside thereof, said channel section being provided with sealing means therein before assembly with another panel on said supporting means, said second flange having an integral sealing lip section extending longitudinally along its upper margin on the inside thereof adapted to fit in the channel section of an adjacent panel on said supporting means and sealingly engageable with the sealing means in the latter channel section to form a sealed standing seam, said plurality of panels being mounted on said supporting means one alongside another with their webs on the supporting means and their flanges standing up from said supporting means with the first and second flanges of adjacent panels alongside one another, and with the lip section on the second flange of one of two adjacent panels sealingly engaging the sealing means in the channel section on the first flange of the other of two adjacent panels, said roof further comprising means for holding each panel down on said supporting means, said hold-down means being secured to said supporting means and having a relatively thin leg extending up between the first and second flanges of adjacent panels and having means at its upper end extending over the sealing lip section at the upper margin of the second flange, said hold-down means comprising sheet metal clips each having a base section by means of which it is fastened to said supporting means, each clip having said leg extending up from said base section, and said means at the upper end of said leg comprising an integral hook hooked over said sealing lip section, said standing seam roof having thermal break means on said supporting means, said base section of the clip having downwardly extending flanges at opposite sides thereof penetrating into said thermal break means, said supporting means comprising purlins and said thermal break means comprising strips of cellular insulation material on the purlins, the base section of each clip being fastened to a purlin by a fastener extending through a hole in the base section and in the strip on the purlin and secured to the purlin, the height of each of said clips from the lower edges of the flanges at opposite sides of the base section of the clip to the top of the hook being such in relation to the height of the second flange of a panel that, with the base section flanges extending down through the strip to the purlin, the second flange of the panel is tightly secured to the purlin by the clip.

6. A standing seam roof as set forth in claim 5 wherein said fastener comprises a screw extending through the strip on the purlin and threaded in the purlin.

7. A standing seam roof as set forth in claim 5 wherein the height of the base section flanges is less than the thickness of the strip and the base section is embedded in the strip.

8. A standing seam roof as set forth in claim 6 wherein the screw has a head engaging the top of the base section, and the base section is bent down by the head of the screw.

9. The method of installing a standing seam roof utilizing a plurality of roof panels, each panel having a web adapted to bear on panel supporting means of a roof and first and second flanges both extending up from the web at opposite sides of the web, said panel being adapted to be mounted on said supporting means adjacent another panel with the webs of the panels bearing on said supporting means, with said flanges standing up from said supporting means, and with the outside of the first flange of one panel along side the outside of the second flange of the other, the first flange of the panel having an integral downwardly opening channel section extending longitudinally along its upper margin on the outside thereof, said channel section being provided with sealing means therein before assembly with another panel on said supporting means, said second flange having an integral sealing lip section extending longitudinally along its upper margin on the inside thereof adapted to fit in the channel section of an adjacent panel on said supporting means and sealingly engageable with the sealing means in the latter channel section to form a sealed standing seam, said method comprising mounting a first of said panels on panel supporting means of a roof with its web engaging said supporting means and its flanges standing up, applying hold-down means for holding said first panel down on said supporting means, said hold-down means being secured to said supporting means adjacent the second flange of the first panel and having a relatively thin leg extending up on the outside of said second flange and means at its upper end extending over the sealing lip section of said second flange, assembling a second panel with the first panel alongside the first panel with the web of the second panel engaging said supporting means and its flanges standing up, the first flange of the second panel extending alongside the second flange of the first panel on the outside of said second flange and said leg of said holding means, and with the lip section on the second flange of the first panel in the channel section on the first flange of the second panel and sealingly engaging the sealing means in said channel section, applying hold-down means for holding down said second panel similarly to the applying of the hold-down means for the first panel, assembling a third panel with the second panel similarly to the assembling of the second panel with the first panel, and continuing adding holddown means and panels in similar manner.

10. The method of claim 9 wherein each successive panel is assembled with the preceding panel by interengaging the channel section on the first flange of the successive panel with the lip section of the preceding panel with the sealing means in the channel section extending under the lip section and with the web of the successive panel above the supporting means, swinging the successive panel down to bring the web of said successive panel down on the supporting means and the first flange of said successive panel into position on the outside of the second flange of the preceding panel and said leg of the holding means, with the lip section on the second flange of the preceding panel in the channel section on the first flange of the succeeding panel and sealingly engaging the sealing means in said channel section.

11. The method of claim 9 or claim 10 wherein the panels are mounted on purlins with the panels extending transversely with respect to the purlins, and wherein thermal break means is provided on the purlins and the panels are applied on said thermal break means, the holddown means for each panel being applied to the thermal break means on a purlin and secured to said purlin through the thermal break means.

12. The method of claim 9 or claim 10 wherein the panels are mounted on purlins with the panels extending transversely with respect to the purlins, and wherein strips of cellular insulation material are placed on the purlins to provide a thermal break, the panels being applied on said strips, the hold-down means for each panel being applied to the strip on a purlin and secured to said purlin by a fastener extending through the strip, the hold-down means being forced down into the strip.

* * * * *